US005353907A

United States Patent [19]

Ogimura et al.

[11] Patent Number: 5,353,907

[45] Date of Patent: Oct. 11, 1994

[54] DUAL-PURPOSE ESCALATOR FOR WHEELCHAIR

[75] Inventors: Yoshio Ogimura, Saitama; Megumi Ookubo, Kanagawa, both of Japan

[73] Assignee: Kabushiki Kaisha Toshiba, Kawasaki, Japan

[21] Appl. No.: 153,969

[22] Filed: Nov. 18, 1993

[30] Foreign Application Priority Data

| | | | |
|---|---|---|---|
| Nov. 18, 1992 | [JP] | Japan | 4-307432 |
| May 21, 1993 | [JP] | Japan | 5-119415 |
| Jun. 30, 1993 | [JP] | Japan | 5-160665 |

[51] Int. Cl.[5] ..... B66B 23/12

[52] U.S. Cl. ..... 198/333

[58] Field of Search ..... 198/324, 333

[56] References Cited

U.S. PATENT DOCUMENTS

| | | | |
|---|---|---|---|
| 4,681,207 | 7/1987 | Goto et al. | 198/333 |
| 5,024,314 | 6/1991 | Kitamura et al. | 198/333 |
| 5,062,519 | 11/1991 | Haruta | 198/333 |

FOREIGN PATENT DOCUMENTS

| | | | |
|---|---|---|---|
| 0443039 | 8/1991 | European Pat. Off. . | |
| 3431610 | 3/1985 | Fed. Rep. of Germany . | |
| 61-178391 | 8/1986 | Japan . | |
| 0275397 | 11/1989 | Japan | 198/333 |
| 0013593 | 1/1990 | Japan | 198/333 |
| 2263461 | 7/1993 | United Kingdom | 198/333 |

OTHER PUBLICATIONS

Patents Abstracts of Japan, vol. 16, No. 541 (M-1336), Nov. 11, 1992, JP-A-42-01987, Jul. 22, 1992.

Patent Abstracts of Japan, vol. 16, No. 144 (M-1207), Feb. 4, 1992, JP-A-32-49093, Nov. 7, 1991.

*Primary Examiner*—James R. Bidwell

*Attorney, Agent, or Firm*—Oblon, Spivak, McClelland, Maier & Neustadt

[57] ABSTRACT

A dual-purpose escalator for a wheelchair including a plurality of steps linked in an endless form and a mainframe having a running path for the steps. The steps include a plurality of specialized steps for loading a wheelchair. The escalator further includes an activating apparatus provided on the running path for causing the specialized steps to alter a configuration thereof to a first state for a wheelchair loading operation mode or to restore the configuration to a second state for normal operation mode. Each of the specialized steps includes a toothed rotor. The activating apparatus includes an engagement member for engaging with the toothed rotor. Each of the toothed rotors is rotated by engaging with the engagement member for causing one of the specialized steps to alter the configuration to the first state when the steps are running in the running path in the wheelchair loading operation mode, respectively. The engagement member includes a base and a plurality of pins set in parallel on the base at a specified pitch for engaging with the toothed rotor. The pin engaging firstly with the toothed rotor is set on the base so as to be capable of displacement from the toothed rotor.

9 Claims, 10 Drawing Sheets

FIG. 1
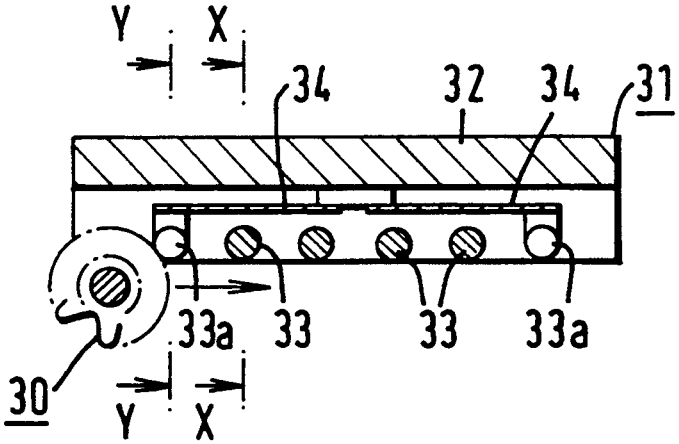
FIG. 2a
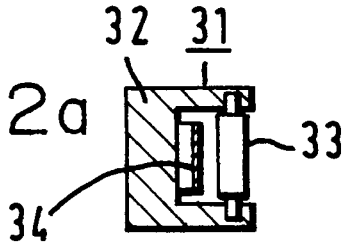
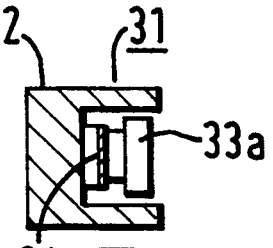
FIG. 2b
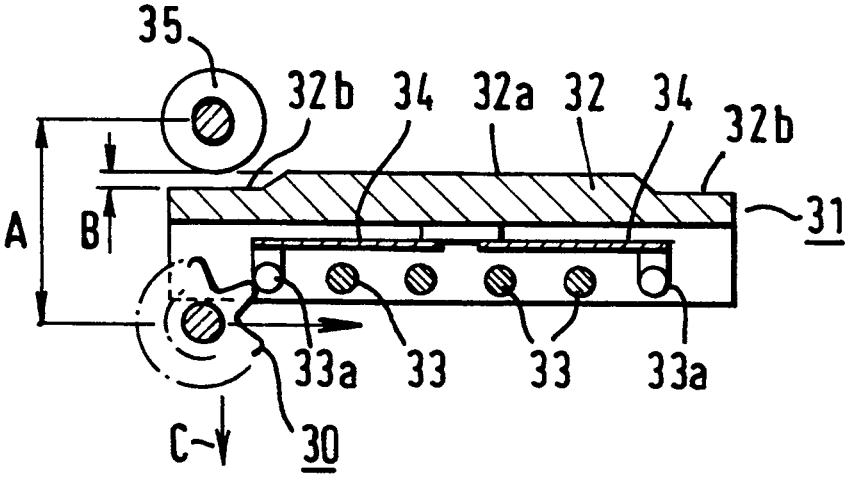
FIG. 3
FIG. 4
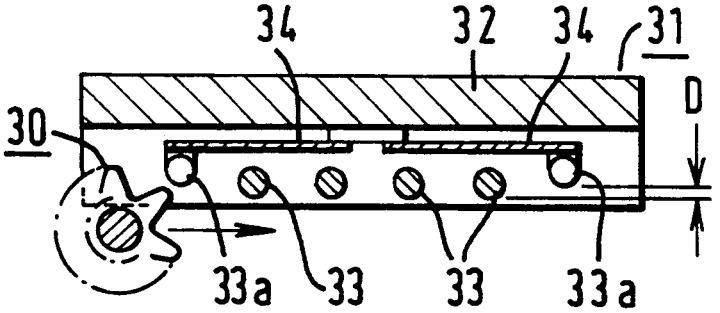

FIG. 9
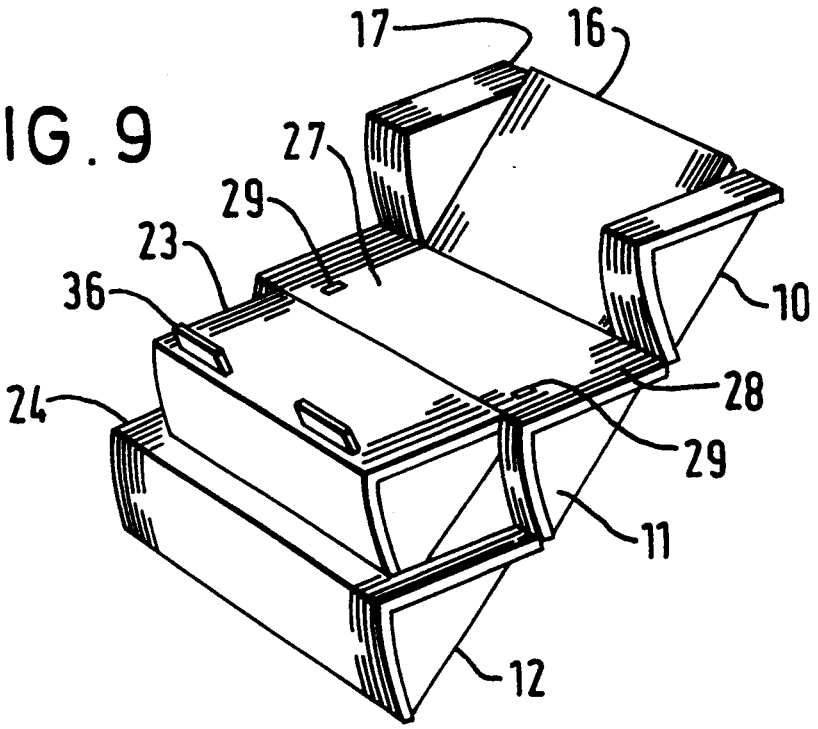
FIG. 10a
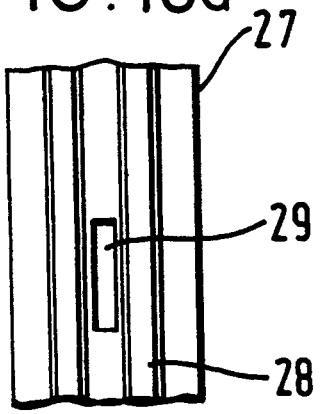
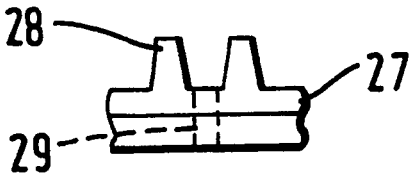
FIG. 10b

DUAL-PURPOSE ESCALATOR FOR WHEELCHAIR

BACKGROUND OF THE INVENTION

1. Field of the Invention

This invention relates to an escalator, and more particularly to a dual-purpose escalator for wheelchairs which is capable of transporting wheelchairs for physically handicapped persons as well as ordinary users.

2. Description of the Related Art

Usually, the general escalators cannot safely transport wheelchairs for physically handicapped persons in the horizontal attitude because the depth dimensions of the steps are short. For this reason, recently, escalator systems have been considered in which specialized steps are included in part of the endlessly arranged multiple steps. These are expanded by mechanically altering their configuration when in the wheelchair loading operation mode. Thus, a deeper space for wheelchair loading can be ensured.

An escalator compatible with wheelchairs is described using FIGS. 15 to 20. In FIG. 15, 1 is a main-frame (generally called a "truss") positioned at a slope between a landing 2 and a landing 3 on lower and upper floors. 4 is a wheelchair in which a physically handicapped person is seated and 5 is an attendant. 6 is an attendant call button provided close to landing 2. 7 are shift switches for the wheelchair loading operation mode provided in balustrade 1*a* of the escalator. 8 are also wheelchair operation buttons.

In FIG. 15, 9 are the multiple steps which are arranged and run in an endless form on a path constructed in main-frame 1 using guiderails and the like. The design is that the treads of several steps 9 become of the same height as each other on the horizontal path sections at the lower and upper floors, and that the treads of each step 9 form stairs with levels differing from each other to run in the sloping section between.

Here, in multiple steps 9, 10 is a first specialized step, 11 is a second specialized step and 12 is a third specialized step. These steps are used for wheelchair loading. 13 is an activating apparatus which causes specialized steps 10, 11 and 12 to alter their configurations to a first state in which a wheelchair can be loaded when in the wheelchair operation mode, or to be restored to a second state for the normal operation mode.

When these first, second and third specialized steps 10, 11 and 12 become in the wheelchair operation mode through shift switch 7, the design is that first specialized step 10 is firstly activated by activating apparatus 13 and part of step 9 is caused to tilt. Then, second specialized step 11 is activated by activating apparatus 13, and a linking system 22 provided inside it is engaged with third specialized step 12. Third specialized step 12, which is linked by linking system 22, is supported by second specialized step 11 on the inclined part of the escalator, so that a level space for loading wheelchairs of just 2 steps is ensured.

Specialized steps 10, 11 and 12 and activating apparatus 13 are further described using FIGS. 16 to 20. First, activating apparatus 13 is provided on main-frame 1 which is the running path for steps 9 to 12, and has rack 13*b* as an engagement member capable of up and down movement through elevator mechanism 13*a*.

Also, first to third specialized steps 10, 11 and 12 are provided with pinions 14*a*, 14*b* and 14*c*, respectively, which are toothed rotors for operating power input which rotate by engaging with rack 13*b* and are mounted on each of their inner lower sides. At the same time, they are provided with drivers 15*a*, 15*b* and 15*c* which drive mechanisms inside the steps linked with pinions 14*a*, 14*b* and 14*c*, respectively. During normal operation mode, these pinions 14*a*, 14*b* and 14*c* do not engage with rack 13*b*, which is withdrawn to the lower position of activating apparatus 13 as shown in FIG. 16. During the wheelchair loading operation mode, the pinions 14*a*, 14*b* and 14*c* rotate by engaging with rack 13*b*, which is raised by elevator mechanism 13*a* of activating apparatus 13 as shown in FIG. 17, while running in the horizontal path sections at the lower or upper floor. Thus, drivers 15*a*, 15*b* and 15*c* are operated in linked motion with pinions 14*a*, 14*b* and 14*c*, respectively.

First, specialized step 10 is provided with a tilting step section 16 capable of tilting partically and a surrounding fixed step section 17. As shown in FIG. 16, in the normal operation mode, a bolt 18*a* projects from driver 15*a* mounted on tilting step section 16 and engages with a retainer 19*a* of fixed step section 17. Thus, tilting step section 16 and fixed step section 17 are incorporated as one horizontal surface. In the wheelchair loading operation mode, drive 15*a* withdraws bolt 18*a* by the rotation of pinion 14*a* which engages with rack 13*b* of activating apparatus 13 as described above, and disengages it from retainer 19*a* as shown in FIG. 17. And when running on the sloping section, tilting step section 16 changes its configuration to a tilted state about a tilting rotation shaft 20, as shown in FIG. 18.

Second specialized step 11 is provided with linking system 22 so that it links with and supports the tread of third specialized step 12 to form a deep tread of 2 step's depth when running on the sloping section.

This linking system 22 links with and supports, or releases the link with, a movable step section 23 of third specialized step 12 by thrusting forward or withdrawing a rack-toothed coupling rod (fork) 22*a* in linked motion via a gear 21 with the forward or reverse rotation of driver 15*b*.

Third specialized step 12 is provided with a movable step section 23 which is supported by linking system 22 of second specialized step 11, and a fixed step section 24 which guides and supports movable step section 23 so as to rise and fall via link 25 of a pantagraph. In the normal operation mode, as shown in FIG. 16, a bolt 18*c* is projected by driver 15*c* mounted on fixed step section 24 and is engaged with a retainer 19*c* of movable step section 23. Thus, movable step section 23 and fixed step section 24 are incorporated as one. When in the wheelchair loading operation mode, as shown in FIG. 17, driver 15*c* withdraws bolt 18*c* and disengages it from retainer 19*c* by the rotation of pinion 14*c* which engages rack 13*b* of activating apparatus 13. At the same time, movable step section 23 is linked with and supported by coupling rod (fork) 22*a* of linking system 22 which thrusts forward from second specialized step 11. The design is as shown in FIG. 18, movable step section 23 follows, even on the sloping section, at the same height as that of second specialized step 11 by means of the upward movement of link 25.

Also, wheel-stops 36 are provided in third specialized step 12 to prevent the falling of a wheelchair during the loading of wheel-chair 4. These wheel-stops 36 are projected from and retracted into the tread by driver 15*c*.

FIGS. 19 and 20 are drawings showing external appearances of first to third specialized steps 10, 11 and 12. FIG. 19 shows the running state on the sloping section in the normal operation mode, and FIG. 20 shows the running state on the sloping section in the wheelchair loading operation mode.

However, escalator constructed in the above, when shifting from the normal operation mode to the wheelchair loading operation mode, as shown in FIG. 17, elevator mechanism 13*a* of activating apparatus 13 operates and raises rack 13*b*, which is the engagement member, while running (in the horizontal path sections at the lower and upper floors). Pinions 14*a*, 14*b* and 14*c*, which are the toothed rotors for inputting the operating forces for first to third specialized steps 10, 11 and 12 which come running in succession, successively engage with rack 13*b* and rotate. Specialized steps 10, 11 and 12 operate through drivers 15*a*, 15*b* and 15*c* which are linked to the pinions 14*a*, 14*b* and 14*c*, respectively, and change their configuration to enable wheelchair loading. However, at this time, when each pinion 14*a*, 14*b* and 14*c* starts to engage with rack 13*b*, the tips of the teeth will mutually interfere and excessive force will be generated if the phases of the two gears are not matched. When moving to the correctly engaged state by the pinion tooth tips sliding over the rack teeth, a shock will occur with a loud noise. This has an adverse effect on the protection of the mechanism and causes insecure feelings in the operators and the wheelchair users.

However, in the prior art dual-purpose escalator for wheelchairs as described above, when the specialized step configuration was being changed or the linking system did not operate, the design was to stop the escalator by operating a safety system. However, it was difficult to judge from the external appearance how the failure had occurred in each respective specialized step. Therefore, it was necessary to carry out an inspection by entering inside trues 1 of the escalator. This gave rise to problems of poor workability and accompanying danger.

The problem in the step construction mentioned above, which is the focal point of this invention, is the wheel-stop mechanism provided in the third specialized step.

As wheel-stop mechanisms proposed in prior art, there are Japanese Patent Publication No. Showa 63-17438 and Japanese Patent Publication No. Showa 63-51956.

Although not illustrated, these are both wheel-stops which are mechanically projected. In their methods the wheel-stops are projected to specified heights or retracted to their original positions when driving forces are applied by wheel-stop mechanisms.

However, these types of wheel-stop mechanisms have the following problems. That is to say, the case of a wheelchair or the like loaded directly above the wheel-stop mechanism for some reason or other can be considered. In such a case, with the wheel-stop mechanisms mentioned above, the following states may happen. That is, the wheel-stops may push the wheelchair upwards, or they may become in an overloaded state in which they cannot move because of the weight of the wheelchair, or the wheel-stop mechanism may be damaged. None of these states is acceptable.

SUMMARY OF THE INVENTION

Accordingly, one object of this invention is to provide a dual-purpose escalator for wheelchairs which starts smooth engagement between the toothed rotors on the specialized steps side and the engagement member of the activating apparatus on the running path side when shifting to the wheelchair loading operation mode, and which is compatible with wheelchair loading with quietness and with a high sense of security by preventing the occurrence of loud noises and shocks.

Another object of this invention is to provide a dual-purpose escalator for wheelchairs which designed to enable increased efficiency in the determination of the cause and in the work of investigation and inspection when an operational failure of the dual-purpose escalator occurs.

Still another object of this invention is to provide a dual-purpose escalator for wheelchairs in which even when a wheelchair or the like is loaded on a wheel-stop, it is designed to detect this and to stop the escalator so that the wheelchair or the like is not endangered and, at the same time, the mechanism is protected.

These and other objects of this invention can be achieved by providing a dual-purpose escalator for a wheelchair including a plurality of steps linked in an endless form and a main-frame having a running path for the steps. The steps include a plurality of specialized steps for loading a wheelchair. The escalator further includes an activating apparatus provided on the running path for causing the specialized steps to alter a configuration thereof to a first state for a wheelchair loading operation mode or to restore the configuration to a second state for normal operation mode. Each of the specialized steps includes a toothed rotor. The activating apparatus includes an engagement member for engaging with the toothed rotor. Each of the toothed rotors is rotated by engaging with the engagement member for causing one of the specialized steps to alter the configuration to the first state when the steps are running in the running path in the wheelchair loading operation mode, respectively. The engagement member includes a base and a plurality of pins set in parallel on the base at a specified pitch for engaging with the toothed rotor. The pin engaging firstly with the toothed rotor is set on the base so as to be capable of displacement from the toothed rotor.

According to one aspect of this invention, there is provided a dual-purpose escalator for a wheelchair including a plurality of steps linked in an endless form and a mainframe having a running path for the steps. The steps include at least two adjacent specialized steps for loading a wheelchair. The escalator further includes an activating apparatus provided on the running path for causing the specialized steps to alter a configuration thereof to a first state for a wheelchair loading operation mode or to restore the configuration to a second state for normal operation mode. A first specialized step of the specialized steps includes a linking system for linking with a second specialized step of the specialized steps. The linking system in the first specialized step includes a coupling rod activated by the activating apparatus for linking the first and second specialized steps to provide a space for loading the wheelchair when the steps are running in the running path in the wheelchair loading operation mode. The first specialized step includes a tread with an inspection port therein for checking the operation of the coupling rod.

According to another aspect of this invention, there is provided a dual-purpose escalator for a wheelchair including a plurality of steps linked in an endless form and a mainframe having a running path for the steps. The steps include a plurality of specialized steps for loading a wheelchair. The escalator further includes an activating apparatus provided on the running path for causing the specialized steps to alter a configuration thereof to a first state for a wheelchair loading operation mode or to restore the configuration to a second state for normal operation mode. One of the specialized steps includes a tread and a wheel-stop activated by the activating apparatus for thrusting out of the tread to prevent the wheelchair from falling off when the steps are running in the running path in the wheelchair loading operation mode. The one of the specialized steps further includes an overload absorption system for preventing the wheel-stop from thrusting out when an overload is applied to the wheel-stop even when the steps are running in the running path in the wheelchair loading operation mode.

With an escalator of the above construction, when shifting to the wheelchair loading operation mode, the toothed rotors of the specialized steps side and the pins of the engagement member of the activating apparatus on the running path side, which is a pinrack, start to engage, even if the teeth of the rotor interfere with the first pin of the engagement member, so that it is capable of displacement. Therefore, interference is kept slight, quiet, and smooth engagement can be achieved. Thus the generation of loud noises and shocks can be prevented.

When using this invention, the operation of the coupling rods can be checked during wheelchair operation through the inspection ports provided in the tread of the specialized step which has the coupling rods. During maintenance inspections, whether or not there is smooth thrusting forward and retraction of the coupling rods can be checked.

In a dual-purpose escalator for wheelchairs provided with specialized steps which have wheel-stops in at least one of multiple steps which are linked and move in circulation, with the above construction, this invention is designed for safety to absorb the overload by an overload absorption system provided in the specialized steps with wheel-stops when an overload equivalent to the weight of a wheelchair occurs due to an unsuitable loading position of a wheelchair.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a cross-section showing the relationship between a toothed rotor and the engagement member in a first embodiment of the escalator of this invention;

FIG. 2(*a*) is a cross-section of FIG. 1 on the line X—X;

FIG. 2(*b*) is a cross-section of FIG. 1 on the line Y—Y;

FIG. 3 is a cross-section showing the relationship between a toothed rotor and the engagement member in a second embodiment of the escalator of this invention;

FIG. 4 is a cross-section showing the relationship between a toothed rotor and the engagement member in a third embodiment of the escalator of this invention;

FIG. 9 is an oblique view showing the external structures of the specialized steps in the wheelchair loading operation mode according to an embodiment of this invention;

FIG. 10 is a drawing showing the positions of the inspection ports according to an embodiment of this invention;

FIG. 11(*b*) is a cross-section showing the wheel-stop system of FIG. 11(*a*) in more detail;

DETAILED DESCRIPTION OF THE PREFERRED EMBODIMENTS

Figure 5:
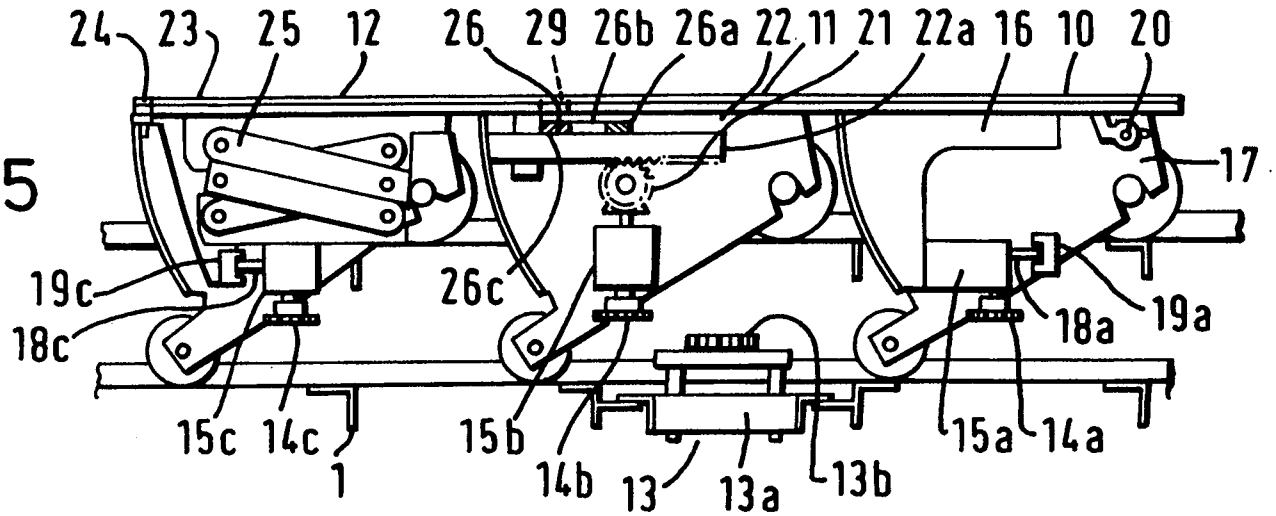
FIG. 5 is a cross-section showing the structures of the specialized steps in the normal operation mode according to an embodiment of this invention.

Referring now to the drawings, wherein like reference numerals designate identical or corresponding parts throughout the several views, the embodiments of this invention will be described below.

The following is a description of a first embodiment of a dual-purpose escalator for wheelchairs of this invention with reference to FIGS. 1 and 2. These show only a toothed rotor 30 provided in specialized steps 10, 11 and 12 for wheelchair loading for power input, and an engagement member 31 of the activating apparatus 13 positioned in the running path.

Toothed rotors 30 are provided instead of pinions 14*a*, 14*b* and 14*c* and engagement member 31 is provided instead of rack 13*b*. The overall construction of the escalator apart from these is the same as in FIGS. 15 to 20 and has been omitted.

In FIGS. 1 and 2, engagement member 31 has a pin-rack structure composed of an oblong base 32 with a U-shaped cross-section and multiple pins 33 which are arranged parallel to each other with a specific pitch in the channel of base 32. Each of pins 33 is a roller pin. Pins 33 are all mounted so that they are free to rotate.

In order to fit this type of pin-rack engagement member 31 in which roller pins 33 are used instead of rack teeth, a sprocket is used as toothed rotor 30 in place of the pinions 14*a*, 14*b* and 14*c* in prior art.

When a pin-rack and a sprocket are used in place of the prior art rack and pinion, despite the composition being simple, the engagement is smooth and not liable to break down, thus having the advantages of maintainability and proof against the environment. However, when sprocket 30 and the line of roller pins 33 in pin-rack engagement member 31 start to engage, and if the phases of the sprocket and the roller pins do not match, the tips of the sprocket teeth and the roller pins will interfere. Thus an excessive force will be produced in both the sprocket and the roller pins and, as the tips of the sprocket teeth slip over the roller pins when moving to a correctly engaged state, a shock will occur accompanied by a loud noise.

Here, as a preventive measure, out of the multiple roller pins 33 of pin-rack type engagement member 31, pin 33*a* which is the first to engage with toothed rotor (sprocket) 30 is supported by base 32 via a spring member 34, such as a plate spring, so that it is capable of displacement (escape) in a direction away from toothed rotor 30.

With this type of construction, in shifting to the wheelchair loading operation mode, when toothed rotor 30 (on the specialized steps side) starts to engage with roller pins 33 of the pin-rack 31, which is the engagement member of the activating apparatus 13 on the running path side, the teeth of rotor 30 may interfere with first pin 33*a* of engagement member 31. Should this happen, first pin 33*a* is supported by spring member 34 so that it is capable of displacement and can escape by the action of the spring. Therefore, quieter and smoother engagement can be achieved by keeping interference to a minimum. Thus, the occurrence of loud noises and shocks can be prevented, and an escalator which is compatible, wheelchair loading with quietness and a high sense of security can be obtained.

FIG. 3 shows a second embodiment of this invention. Here, toothed rotor (sprocket) 30 is guided and supported at the position of first contact with engagement member 31 so as to be capable of escape movement away from engagement member 31. That is to say, both toothed rotor (sprocket) 30 and a guide roller 35 are kept at a constant spacing A from each other on the vertical axis via a connecting member (not illustrated). The sprocket is mounted inside the specialized step so that it is capable of moving with a specified stroke in the transverse direction (the direction orthogonal to the forward direction). At the same time, recessed, surfaces 32*b* with slopes are formed at the front and rear ends of the back surface 32*a* of base 32 of engagement member 31, which is the pin-rack.

In this way, when the teeth of rotor 30, which is the sprocket, interfere with first roller pin 33*a* of engagement member 31, the first roller pin 33*a* escapes through spring action in the same way as in the first embodiment. At the same time, rotor 30, together with guide roller 35, move in the C direction escaping from roller pin 33*a* by space B between Guide roller 35 and recessed surface 32*b*. By this means, interference is even further suppressed, and even quieter and smoother engagement can be achieved. At the same time, the design also provides that rotor 30 securely engages with the second and succeeding roller pins 33 by moving forward under the guidance of guide roller 35 rolling over rear surface 32*a* of base 32.

FIG. 4 shows a third embodiment of this invention. Here, roller pin 33*a*, which is the first roller pin of pin-rack type engagement member 31 to engage with toothed rotor 30, is supported beforehand in a position which is withdrawn further than the other roller pins 33 from toothed rotor 30 by distance D, which is small. By this means the chance of interference between first roller pin 33*a* and toothed rotor 30 is decreased and, at the same time, even if interference should occur, first pin 33*a* will escape by the spring action of spring member 34 in the same way as in the previous embodiments. Thus, interference is suppressed, and even quieter engagement can be achieved.

The following is a description of another embodiment of this invention with reference to the drawings. Since the overall structure of the dual-purpose escalator for wheelchairs in this embodiment is the same as in FIG. 15, the explanation has been omitted, but the practical structures of the specialized steps and their operation are described.

Figure 6:
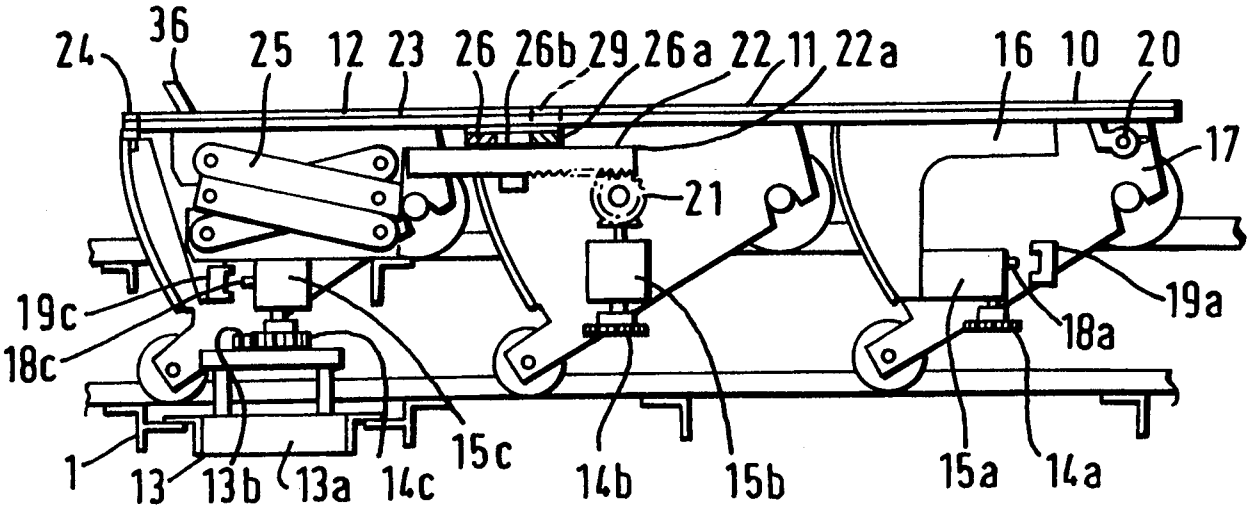
FIG. 6 is a cross-section showing the structures of the specialized steps in the wheelchair loading operation mode according to an embodiment of this invention.

FIG. 5 shows the case in normal operation when the specialized steps are not activated. FIG. 6 shows the case in which the specialized steps are activated and operated for loading a wheelchair.

Indicator plates 26 are provided on the upper surfaces of coupling rods 22*a*. Each indicator plate 26 is composed of a white indicator plate 26*a*, a red indicator plate 26*b* and a blue indicator plate 26*c* in the longitudinal direction. Also, as shown in FIG. 10, inspection ports 29 are provided in the grooves of cleats 28 of tread 27 above indicator plates 26 so that the differences of color on indicator plates 28 can be seen.

Figure 7:
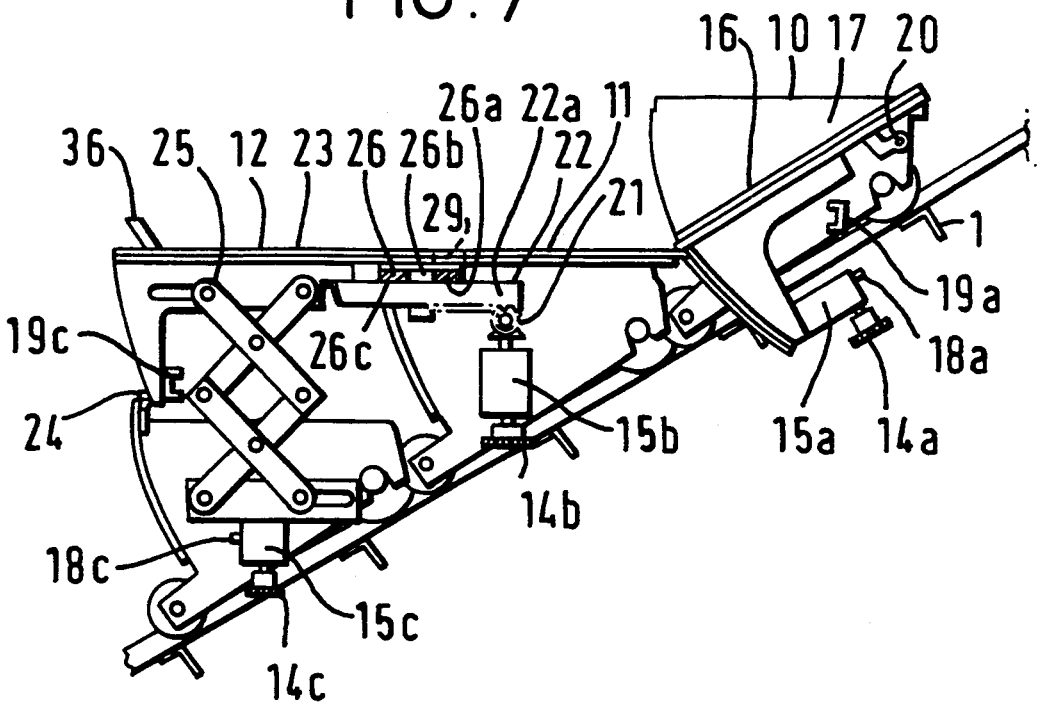
FIG. 7 is a cross-section showing the structures of the specialized steps in the wheelchair loading operation mode according to an embodiment of this invention.
Figure 8:
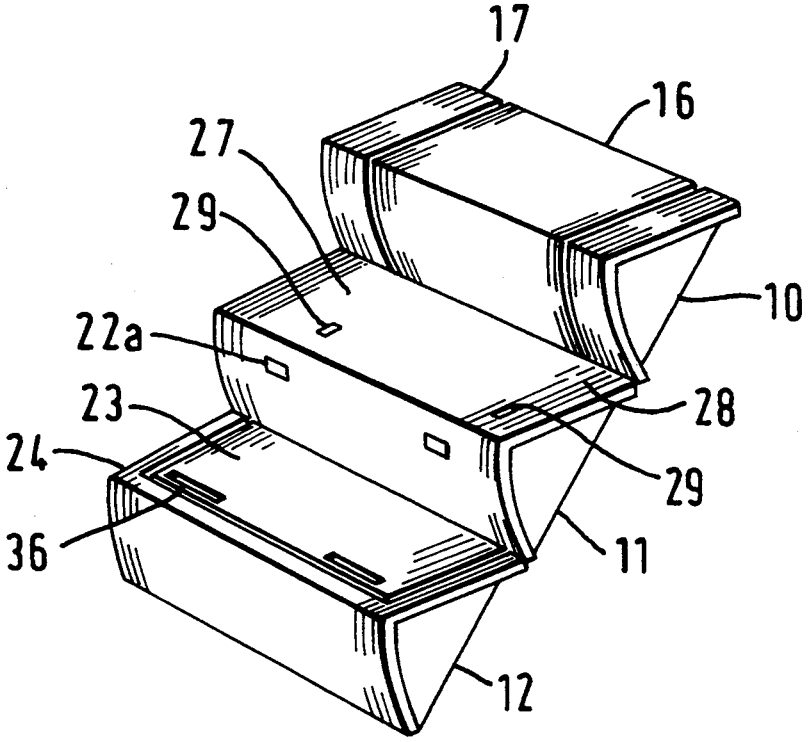
FIG. 8 is an oblique view showing the external structures of the specialized steps in the normal operation mode according to an embodiment of this invention.

FIG. 7 shows the state when specialized steps 10, 11 and 12 are activated and are running on the slope in a state capable of loading a wheelchair. FIGS. 8 and 9 are drawings showing external appearances of the specialized steps. FIG. 8 is the normal running state, and FIG. 9 is the state capable of loading a wheelchair.

An escalator capable of transporting wheelchairs is constructed as described above so that a space for wheelchair loading is ensured by linking specialized steps 10, 11 and 12.

In the normal operation state of FIG. 8, mainly the blue color (of blue indicator plates 26*c*) can be seen through inspection ports 29. Thus, attendant 5 can confirm that coupling rods 22*a* are correctly retracted by checking this the color. As opposed to this, in the wheelchair operation mode shown in FIG. 9, mainly the white color of white indicator plates 25*a* can be seen through inspection ports 29, so that the correct linking operation of coupling rods 22*a* can be confirmed. Also, the design provides that in the case when the red color of red indicator plates 26*b* can be seen through inspection ports 29, coupling rods 22*a* have not correctly performed the linking or retraction operation, and escalator stops through a safety system (which is not illustrated). For this reason, the attendant can immediately judge the cause of the escalator stopping, and a resetting operation for the breakdown can be performed within a short period of time. Also, during periodical inspection and maintenance periods, there is no requirement to go to the trouble of checking the operation of the internal mechanisms of the specialized steps from inside truss 1. This can be done merely by checking the operation of indicator plates 26 through inspection ports 29. Therefore, improvement of operational efficiency and safety can both be designed.

Figure 11A:
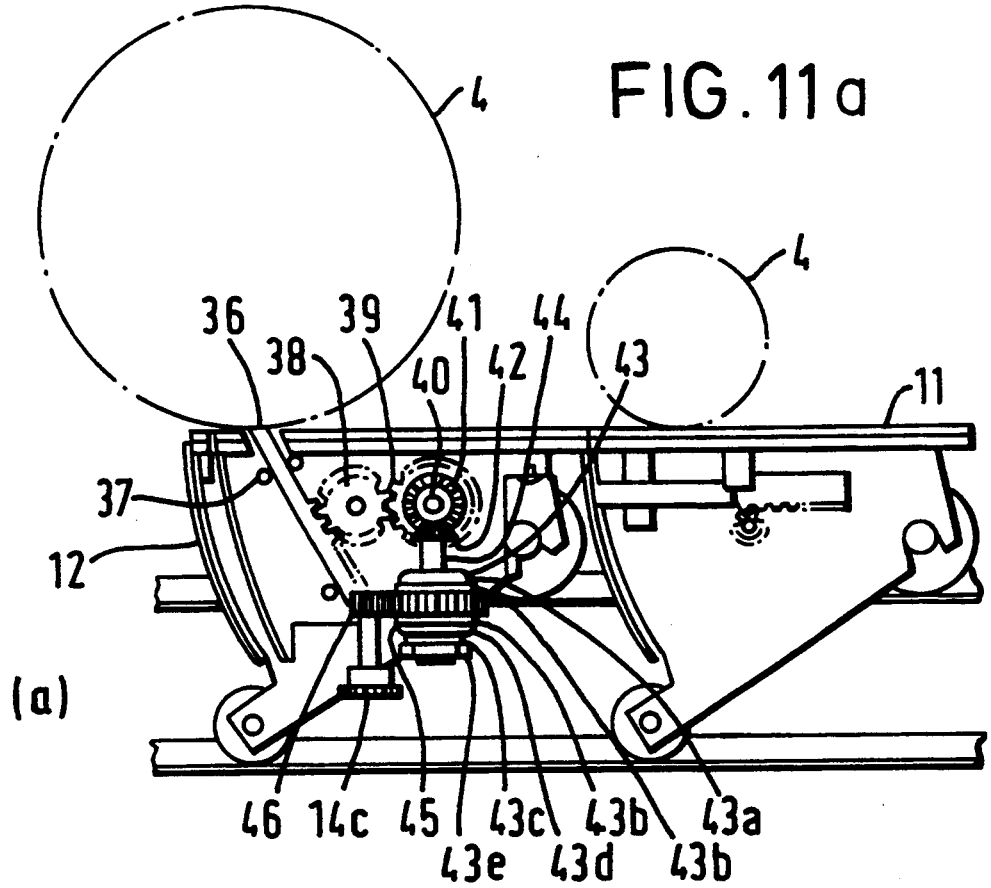
FIG. 11(*a*) is a cross-section of a step which has the wheel-stop system according to another embodiment of this invention.
Figure 11B:
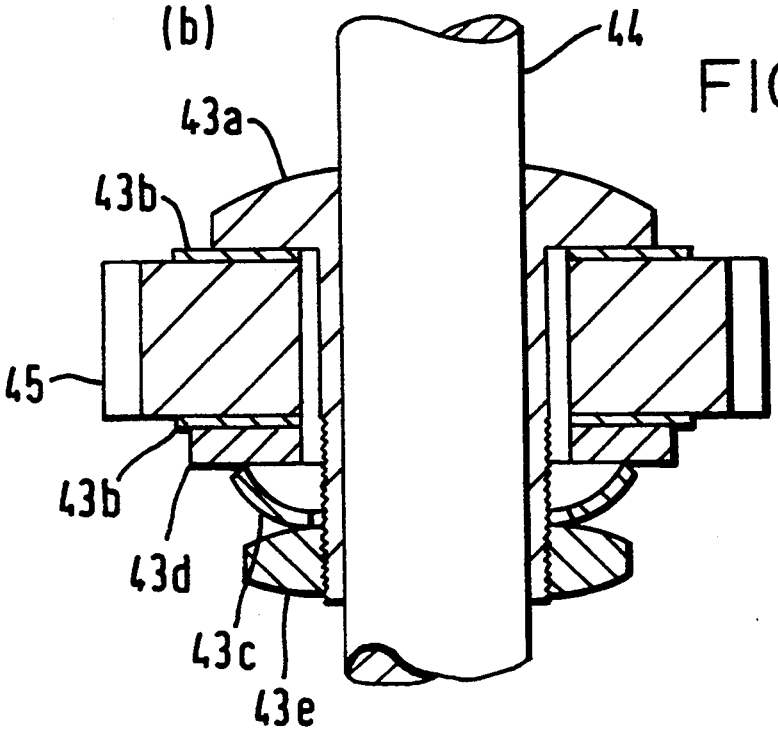
Figure 12:
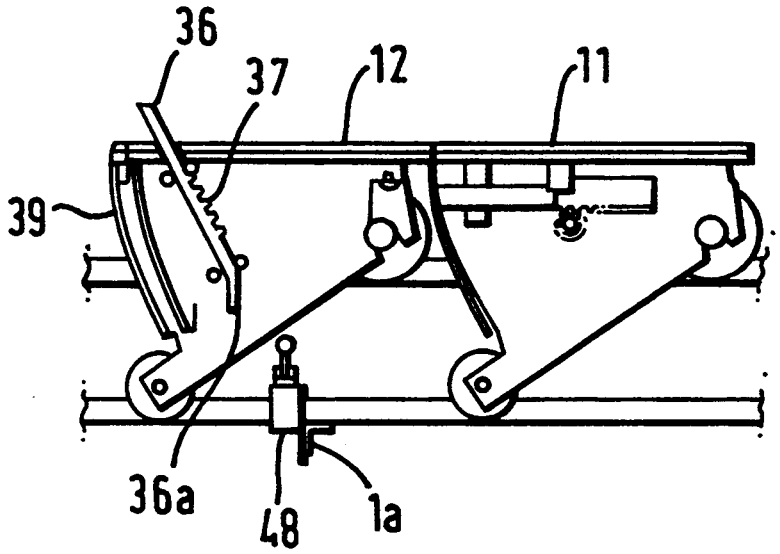
FIG. 12 is a cross-section of a step which has the wheel-stop system according to another embodiment of this invention in the case where the wheel-stop advances.
Figure 13:
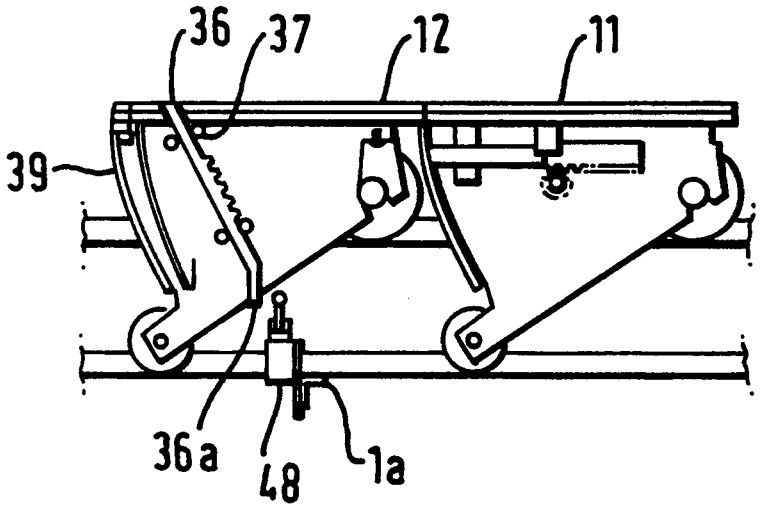
FIG. 13 is a cross-section of a step which has the wheel-stop system according to another embodiment of this invention in the case where a wheelchair is on the wheel-stop.

The following is a description of still another embodiment of this invention with reference to FIGS. 11 to 13. In these drawings, those items in which the constructions in FIGS. 15 to 20 are repeated have been given the same symbols and their descriptions have been simplified. FIG. 11(*a*) shows a cross-section of a step which has the wheel-stop system according to an embodiment of this invention, and FIG. 11(*b*) shows the detailed construction of an overload absorption system. In FIG. 11, 36 is wheel-stop, 37 is a wheel-stop guide roller, 38 is a pinion which engages with the wheel-stop 36, 39 is a spur gear which engages with the pinion 38, 40 is a shaft of spur gear 39, 41 is a bevel gear secured to the same shaft as spur gear 39 and 42 is a bevel gear which engages with bevel gear 41. 43 is an overload absorption system mounted on bevel gear shaft 44, and is composed of a hub 43*a*, friction plates 43*b*, a spring 43*c*, a keep plate 43*d* and a nut 43*e*. A gear wheel 45 is sandwiched between friction plates 43*b*. 46 is a spur gear which engages with gear wheel 45.

FIG. 12 shows the case where wheel-stop 36 advances and FIG. 13 shows the case where a wheelchair is on wheel-stop 36.

In FIGS. 12 and 13, 36*a* is a detector arm which extends the lower part of wheel-stop 36 further than the underside of a riser 49. 48 is a limit switch provided on escalator truss 1 in the path of detector arm 36*a*.

Figure 14:
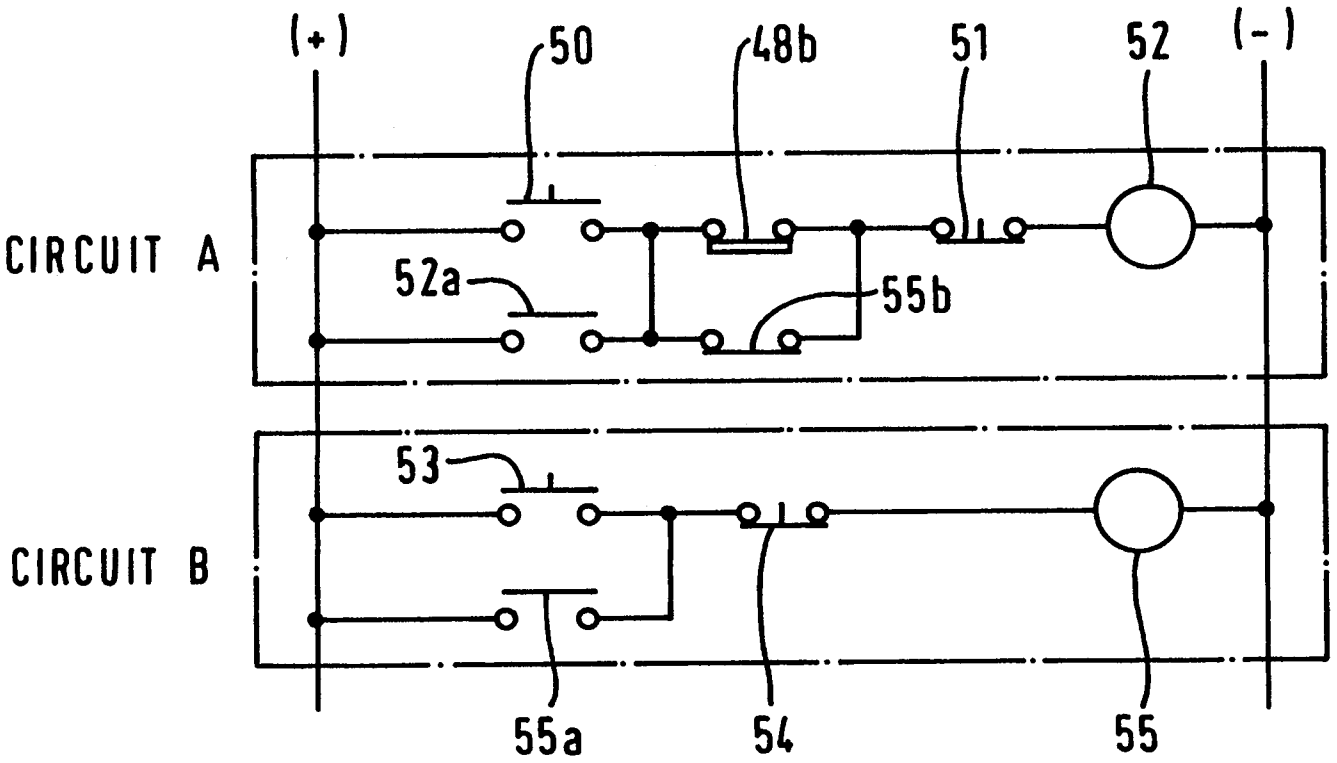
FIG. 14 is a control circuit diagram for the escalator according to another embodiment of this invention.
Figure 15:
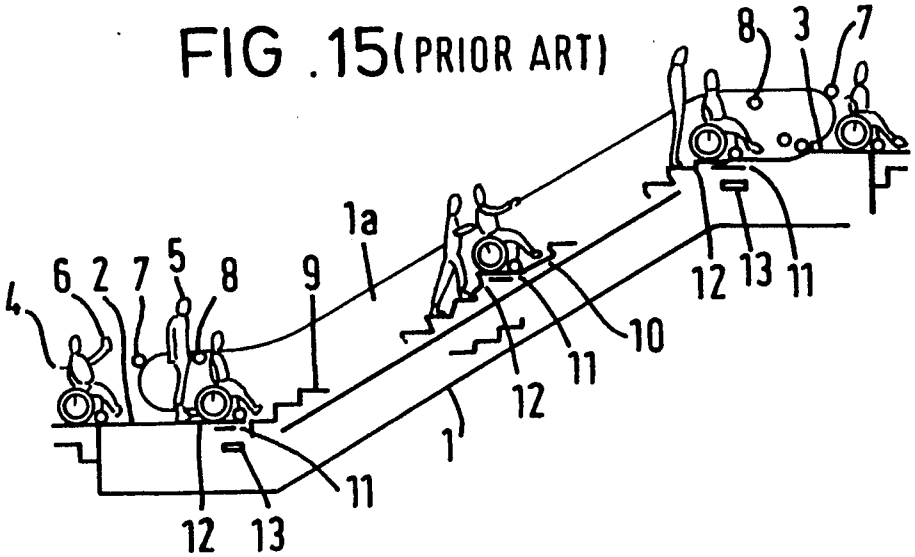
FIG. 15 (PRIOR ART)
FIG. 15 is a schematic drawing of a prior art dual-purpose escalator for wheelchairs.
Figure 16:
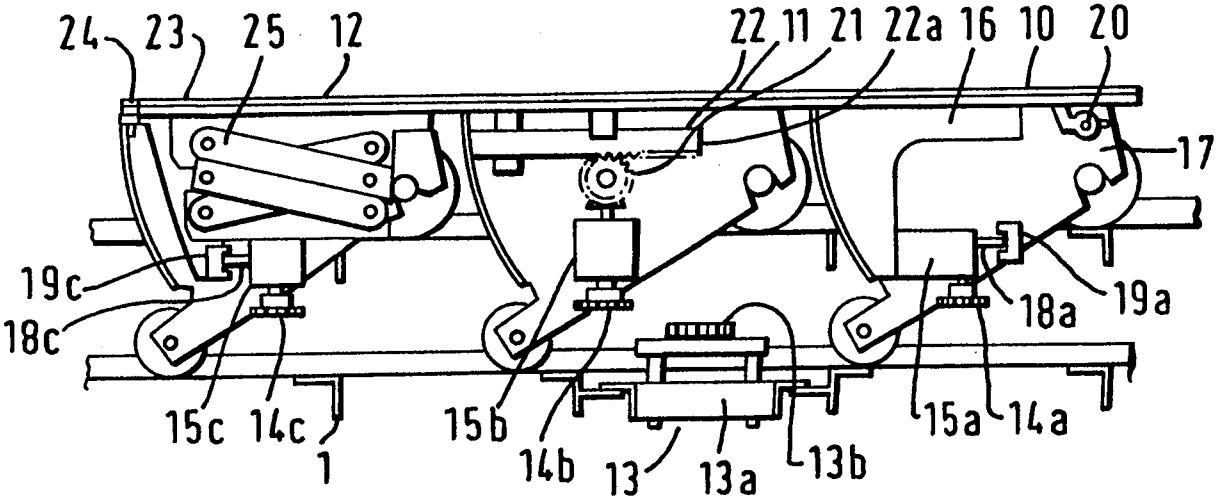
FIG. 16 (PRIOR ART)
FIG. 16 is a structural drawing of the specialized steps and the activating apparatus of the prior art escalator in FIG. 15 in the normal operation mode.
Figure 17:
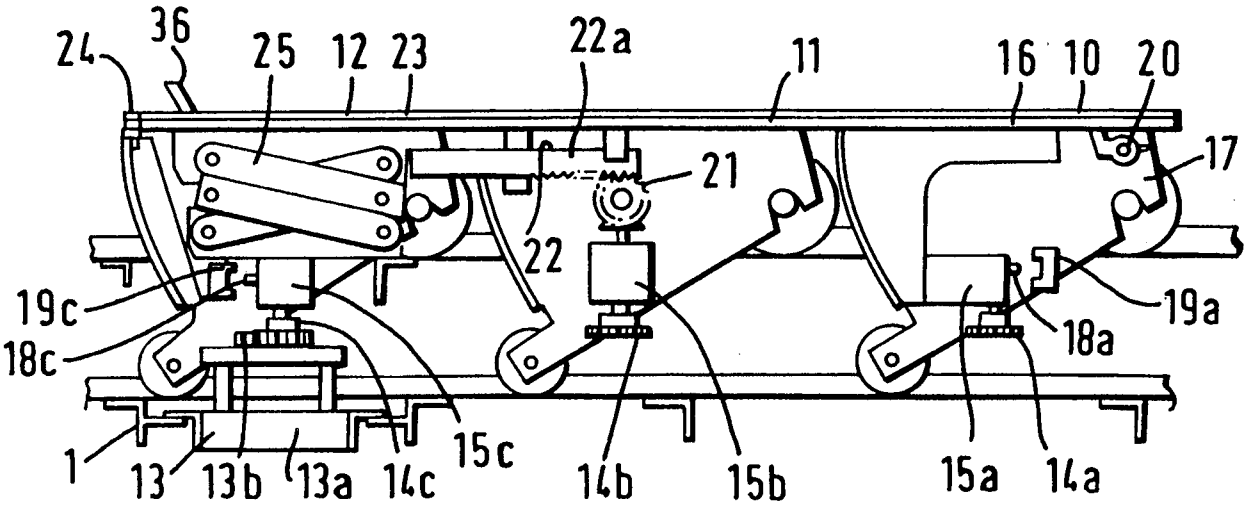
FIG. 17 (PRIOR ART)
FIG. 17 is a drawing showing the states of the specialized steps and the activating apparatus of the prior art escalator in FIG. 15 when shifting to the wheelchair loading operation mode.
Figure 18:
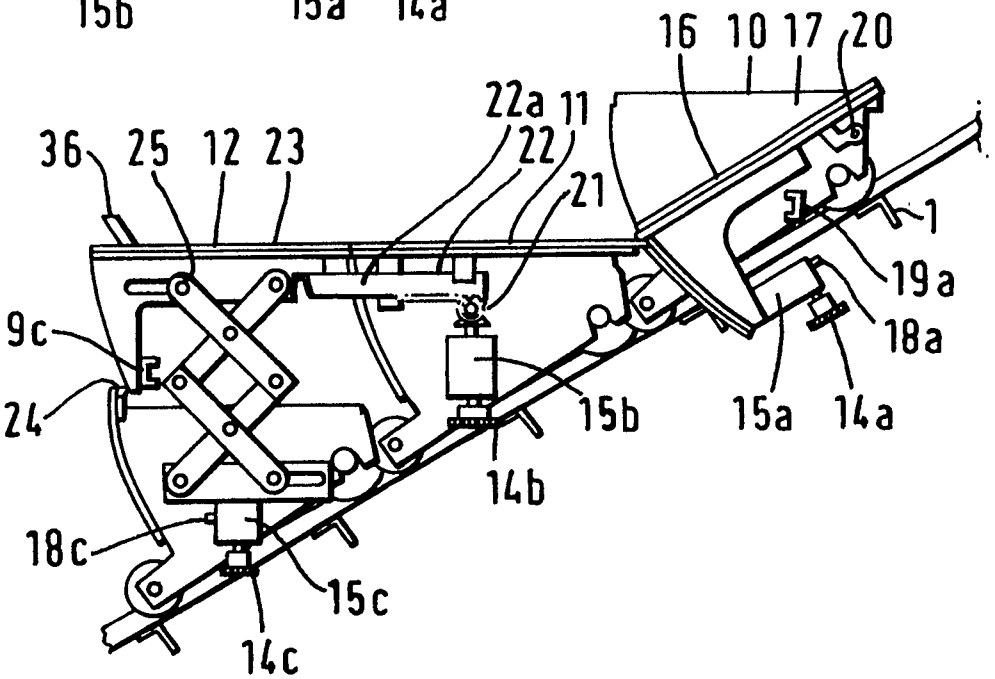
FIG. 18 (PRIOR ART)
FIG. 18 is a drawing showing the state of the specialized steps on the running path on the sloping section when in the wheelchair loading operation mode in the prior art escalator in FIG. 15.
Figure 19:
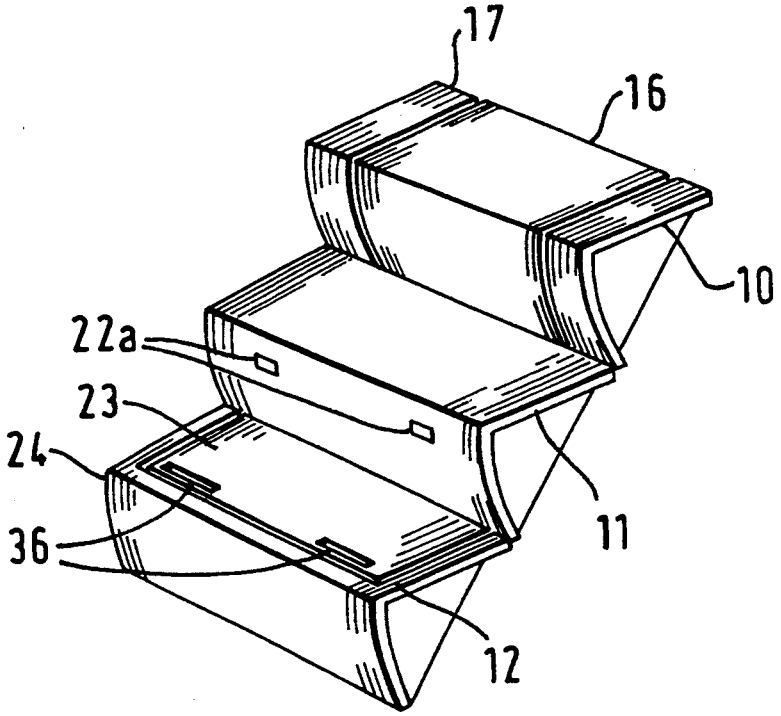
FIG. 19 (PRIOR ART)
FIG. 19 is a drawing showing the external appearance of the state of the specialized steps on the running path on the sloping section when in the normal operation mode in the prior art escalator in FIG. 15.
Figure 20:
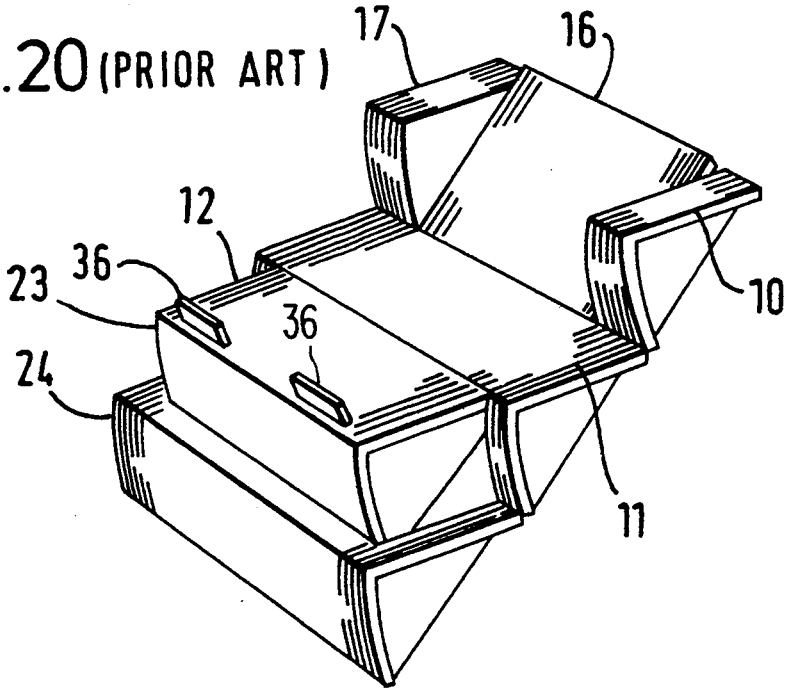
FIG. 20 (PRIOR ART)
FIG. 20 is a drawing showing the external appearance of the state of the specialized steps on the running path on the sloping section when in the wheelchair loading operation mode in the prior art escalator in FIG. 15.

FIG. 14 shows the essential parts of the escalator control circuit. 50 is an escalator starting switch and 51 is a stopping switch. 52 is an escalator starting relay. 52*a* are normally-open contacts for self-holding. 53 is a wheelchair operation switch. 54 is a wheelchair operation ending switch. 55 is a wheelchair operation relay. 55*a* are normally-open contacts for the self-holding of relay 55. 55*b* are contacts which are normally closed and only open for wheelchair operation. 48*b* are the normally-closed contacts of limit switch 48.

The following is a description of the operation of this embodiment.

In FIGS. 11 to 14, when no load is applied to wheel-stop 36, spur gears 45 and 46 are rotated by the drive input applied to pinion 14*c*. Hub 43*a* rotates under the frictional torque between spur gear 45 and friction plate 43*b*. This torque is sequentially transmitted to level gear 42, level gear 41, shaft 40, spur gear 39 and pinion 38 so that wheel-stop 36 advances. As shown in FIG. 12, when wheel-stop 36 advances, detector arm 36*a* rises, and, therefore, even if the escalator advances in this state, limit switch 48 will not operate.

When a wheelchair or the like is on wheel-stop 36, even if a driving force is supplied to pinion 14*c*, slip will occur between spur gear 45 and friction plates 43*b* and thus wheel-stop 36 will not project. At such a time, as shown in FIG. 13, detector arm 36*a* of wheel-stop 36 is in the lowered position. Thus, when the escalator advances, detector arm 36*a* will operate limit switch 48.

The stopping operation for the escalator at this time is described with reference to FIG. 14. The escalator is started by starting switch 50, and starting relay 52 is excited so that a self-holding circuit is formed by contacts 52*a*. When wheelchair operation switch 53 is closed in order to shift to wheelchair operation, wheelchair operation relay 55 is excited. By this means, normally-closed contacts 55*b* of circuit A will open so that wheelchair operation is commenced. At this time, when limit switch 48 operates as described above and its contacts 48*b* open, starting relay 52 is de-energized. Thus the escalator is stopped.

When the escalator is in normal operation, its state is as in FIG. 13, which means that limit switch 48 is always operating. However, at this time, wheelchair operation relay 55 of circuit B is de-energized and normally-closed contacts 55*b* of circuit A remain in the closed state. Thus, even if contacts 48*b* open, starting relay 52 will not be de-energized and the operation of the escalator can continue.

In this way, if this embodiment is applied, when an overload is applied to a wheel-stop, the design is that the wheel-stop is not forced by the overload absorption system to project. Also, the escalator can be made to operate so that it stops automatically at such times. Thus a dual-purpose escalator for wheelchairs with high safety can be provided.

Since this invention is constructed as described above, shifting to the wheelchair loading operation mode, can be commenced with smooth engagement between the toothed rotors on the specialized steps side and the engagement member of the activating apparatus on the running path side. Thus, the occurrence of loud noises and shocks can be prevented, and an escalator which is compatible with wheelchair loading with quietness and with a high sense of security can be obtained.

When using the above invention, an escalator can be provided with the following improvements: increased efficiency in determining the cause and investigation, inspection operations when the performance of the escalator is poor; and increased workability and safety during periodical inspection and maintenance.

When using the above invention, in the case of a wheelchair being loaded above a wheel-stop, the wheelchair will not be pushed upward or overturned or will not become in an overloaded state, nor will the wheel-stop drive mechanism be damaged by the forced projection of the wheel-stop. Furthermore, the escalator can be stopped automatically when the wheel-stop projection operation does not occur. Therefore, the safety of wheelchair users and of the escalator system can be improved.

Obviously, numerous modifications and variations of the present invention are possible in light of the above teachings. It is, therefore, to be understood that within the scope of the appended claims, the invention may be practiced otherwise than as specifically described herein.

What is claimed is;

1. A dual-purpose escalator for a wheelchair, comprising:

a plurality of steps linked in an endless form;

a main-frame including a running path for said steps;

said steps including a plurality of specialized steps for loading a wheelchair; and activation means provided on said running path for causing said specialized steps to alter a configuration thereof to a first state for a wheelchair loading operation mode or to restore said configuration to a second state for normal operation mode;

each of said specialized steps including a toothed rotor;

said activation means including an engagement member for engaging with said toothed rotor;

each of said toothed rotors being rotated by engaging with said engagement member for causing one of said specialized steps to alter said configuration to said first state when said steps are running in said running path in said wheelchair loading operation mode;

said engagement member including a base and a plurality of pins set in parallel on said base at a specified pitch for engaging with said toothed rotor; and said pin engaging firstly with said toothed rotor being set on said base so as to be capable of displacement from said toothed rotor.

2. The dual-purpose escalator of claim 1, wherein:

said engagement member further includes a spring member; and said pin engaging firstly with said toothed rotor is supported on said base through said spring member.

3. The dual-purpose escalator of claim 2, wherein: said toothed rotor is guided and supported at a position of first contact with said engagement member so as to be capable of escape movement away from said engagement member.

4. The dual-purpose escalator of claim 3, wherein:

in said base of said engagement member, a recessed surface with slope is formed at said position of first contact with said engagement member.

5. The dual-purpose escalator of claim 2, wherein:

said pin engaging firstly with said toothed rotor is supported in a position slightly more withdrawn from said toothed rotor than the other of said pins.

6. A dual-purpose escalator for a wheelchair, comprising:

a plurality of steps linked in an endless form;

a main-frame including a running path for said steps;

said steps including at least two adjacent specialized steps for loading a wheelchair; and activation means provided on said running path for causing said specialized steps to alter a configuration thereof to a first state for a wheelchair loading operation mode or to restore said configuration to a second state for normal operation mode;

a first specialized step of said specialized steps including linking means for linking with a second specialized step of said specialized steps;

said linking means in said first specialized step including a coupling rod activated by said activation means for linking said first and second specialized steps to provide a space for loading said wheelchair when said steps are running in said running path in said wheelchair loading operation mode; and said first specialized step including a tread with an inspection port therein for checking the operation of said coupling rod.

7. The dual-purpose escalator of claim 6, wherein:

said linking means further includes an indicator plate provided on the upper surface of said coupling rod which is capable of checking the operation of said coupling rod through said inspection port.

8. A dual-purpose escalator for a wheelchair, comprising:

a plurality of steps linked in an endless form;

a main-frame including a running path for said steps;

said steps including a plurality of specialized steps for loading a wheelchair; and activation means provided on said running path for causing said specialized steps to alter a configuration thereof to a first state for a wheelchair loading operation mode or to restore said configuration to a second state for normal operation mode;

one of said specialized steps including a tread and a wheel-stop activated by said activation means for thrusting out of said tread to prevent said wheelchair from falling off when said steps are running in said running path in said wheelchair loading operation mode; and said one of said specialized steps further including overload absorption means for preventing said wheel-stop from thrusting out when an overload is applied to said wheelchair even when said steps are running in said running path in said wheelchair loading operation mode.

9. The dual-purpose escalator of claim 8, further comprising:

stopping means for stopping said dual-purpose escalator when said overload is applied to said wheel-stop.

* * * * *